United States Patent [19]

Vieten

[11] Patent Number: 4,763,375

[45] Date of Patent: Aug. 16, 1988

[54] TOOTHBRUSH

[76] Inventor: Michael J. Vieten, 81 Eighth Ave., Brooklyn, N.Y. 11215

[21] Appl. No.: 894,789

[22] Filed: Aug. 8, 1986

[51] Int. Cl.[4] ..... A46B 9/04

[52] U.S. Cl. ..... 15/106; 15/167.1; 15/145; 15/176; D4/105

[58] Field of Search ..... 15/106, 167 R, 167.1, 15/143 R, 145, 22 R, 22 A, 176, 172; D4/105

[56] References Cited

U.S. PATENT DOCUMENTS

| | | | |
|---|---|---|---|
| 1,132,326 | 3/1915 | Fouyer | 15/167 R |
| 1,458,074 | 6/1923 | Pikoos | 15/167 R |
| 3,316,576 | 5/1967 | Urbush | 15/22 R |

FOREIGN PATENT DOCUMENTS

| | | | |
|---|---|---|---|
| 154683 | 11/1920 | United Kingdom | 15/167 R |
| 162152 | 4/1921 | United Kingdom | 15/167 R |

*Primary Examiner*—Peter Feldman

*Attorney, Agent, or Firm*—John H. Faro

[57] ABSTRACT

An improved toothbrush having a handle and two sets of bristles; one set of bristles being disposed on each end of the handle. One set of bristles is configured as a conventional toothbrush and may, thus, have any one of a number of combinations of bristles and shapes for performing routine dental hygiene. The other end of the brush is unique in both the configuration of the supporting portion of the handle, the crescent configuration of the bristles and the articulation (pivoting action) of the crescent-shaped toothbrush relative to the handle. This portion of the handle is further modified (curved) to support the crescent-shaped bristle as to place them in opposing relationship to the inside surface of the user's teeth. This is achieved without any strain or unorthodox positioning of the brush by the user. Since the crescent-shaped toothbrush is able to articulate (pivot) relative to the handle, it is equally effective in cleansing all inside surfaces of the teeth, not simply the front teeth.

7 Claims, 1 Drawing Sheet

TOOTHBRUSH

BACKGROUND OF THE INVENTION

1. Field of the Invention

This invention is directed to a device. More specifically, this invention concerns itself with a unique toothbrush configuration having two distinct bristle configurations, one on each end of the handle.

2. Description of the Prior Art

The need to properly brush one's teeth is a proposition that needs little if any further explanation. Good dental hygiene is essential for the prevention of tooth decay, the elimination of bad breath, and healthy gums. It has long been recognized that proper brushing is required to stimulate the gum tissue and the prevention of plaque which can lead to gum disease, tooth decay, and eventually permanent tooth loss.

As is also fairly apparent, the present state of the art in toothbrush design has up to now been limited to modification in the angle of bristles relative to the handle and different combinations of bristles in the brush itself. This design is recognized as fairly effective and efficient for cleansing the surface of the teeth which are in plain view (the outside surface). The efficiency of current toothbrush designs does not, however, address the more difficult problem of cleansing the inside surfaces of the teeth. At best, such designs do a poor job on the inside surfaces of a portion of the teeth and are totally ineffective for the cleansing of the inside surfaces of some teeth altogether—even if the user is persistent and adept enough to brush his teeth with both his right and left hand.

Alternative toothbrush designs have been proposed in the past, and for one reason or another, have failed to capture the attention of toothbrush manufacturers, the dental health profession and the consumer. Many of these designs attempt to address the shortcomings in the configurations which are presently commercially available. A number of these alternate configurations are represented in the following issued patents: U.S. Pat. Nos. 2,051,687 (to Dressler); 2,084,873 (to Strause); 2,697,239 (to Funk); and Des. 241,286 (to Hadley).

U.S. Pat. No. 2,051,687 (to Dressler), describes a toothbrush comprising a handle having an array of bristles (brush) on one end thereof. This brush appears to be a separate and independent element which is detachably connected to the handle through a series of complimentary fittings. The bristle support and bristles themselves form a convex cleansing appliance which is configured for cleansing the inside surfaces of the user's teeth. In the embodiments of this invention illustrated in the Dressler patent, the brush and handle can be engaged to one another in any one of three different positions. By switching the handle from one position to another, it is possible for the user to clean all the inside surfaces of his teeth without changing hands or otherwise shifting the position of the brush within his hand. Dressler clearly recognizes the inadequacies of early designs which employ a crescent-shaped brush in a single or fixed position. Dressler's concept, although designed to overcome this limitation, is cumbersome and relatively inefficient. More specifically, Dressler would require the user to periodically interrupt brushing of the inside surface of his teeth to change the position of the crescent-shaped brush relative to the handle. In practice, the user would be required to reposition the crescent-shaped brush at least twice during each brushing sequence. This is not only time consuming and somewhat awkward, but also conceivably requires reapplication of tooth paste to the brush and the rinsing of the user's hands. Other limitations in the Dressler design include the possible and unintended detachment of the brush from the handle during brushing, thus, requiring the user to interrupt the cleansing of his teeth and reconfigure the toothbrush.

U.S. Pat. No. 2,084,873 (to Strause), describes a toothbrush having a "S" shaped handle and two different configuration of bristles (brushes), one configuration being positioned on each end. One set of bristles is designed for cleansing the outer surfaces of the teeth (reference numerals 9,10); and the other "dome" shaped bristles) the inside surfaces of the teeth. The single fixed position of the crescent-shaped brush is, thus, ineffective to cleanse the inside surface of the teeth of the lingual arch. At best, the user of the Strauss brush will be required to frequently reposition the brush relative to the inside surface of the teeth on either side of the mouth. The unorthodox handle further complicates the manipulation of the brush relative to the inside surface of the front teeth.

U.S. Pat. No. 2,697,239 (to Funk), describes a toothbrush having a crescent-shaped bristle configuration designed to fit the front lingual arch of the user's mouth. The Funk design is distinct from the configuration of the Dressler patent (previously discussed) in that the tips of bristles in the Dressler design are contoured specifically to fit the front lingual arch, whereas the Funk design aligns the side of the bristles to conform to the front lingual arch. The tips of the bristles are, thus, not in direct opposing contact with the surface of the teeth. The Dressler patent was not cited as prior art of record during the prosecution of the Funk patent. The Funk design, thus, suffers from the same limitations confronted by Dressler at the time of the definition of the Dressler concept. In summary, the Funk device is clearly limited in its ability to cleanse the inside surfaces of the teeth in the front lingual arch, due to the inappropriate orientation of the tips of the bristles relative to the inside surfaces of the teeth and the single or fixed position of the brush relative to the handle.

U.S. Pat. No. Des. 241,286 (to Hadley), describes a unique handle design for a Dressler-like toothbrush. Unlike Dressler, however, the Hadley handle is integral with the bristle support and is not detachable from the bristle support. The Hadley design, thus, suffers from many of the same limitations inherent in the Dressler and Funk configurations (i.e. fixed position bristles, awkward for cleansing of inside surface of teeth outside of the front lingual arch, etc.—the term "fixed" as used in reference to the Dressler configuration, referring to the position of the bristles relative to the handle orientation during the cleasning operation).

As is evident from the foregoing discussion, current toothbrush design leaves a great deal to be desired, particularly with respect to cleansing of the inside surfaces of one's teeth. Alternatives to the present standard design have been put forth and have not proven attractive enough from the standpoint of convenience or effectiveness to displace the current standard. One possible reason for such reluctance or indifference by manufacturers to change from the standard design is the mistaken belief that consumers are satisfied and/or would not accept any revolutionary change, notwithstanding the relative ineffectiveness of the standard design to effectively clean the inside surfaces of the user's teeth. With the increasing public awareness of the relationship between plaque and peridontal disease, the shortcomings inherent in standard toothbrush design, consumers and dental healthcare professionals are becoming increasingly dissatisfied with the cleansing efficiency of a standard toothbrush. Unfortunately, one of the proposed alternatives to this design have apparently been sufficiently effective or attractive to displace the standard toothbrush design either in the eyes of the manufacturer or the potential customer. Thus, there remains a continuing unfulfilled need in improvement to the current state of the art in these dental hygiene appliances.

OBJECTS OF THE INVENTION

It is the object of this invention to remedy the above as well as related deficiencies in the prior art.

More specifically, it is the principle object of this invention to provide an improved toothbrush which is specifically designed for cleansing both the inside and outside surfaces of an individual's teeth.

It is another object of this invention to provide an improved toothbrush having two distinct bristle configurations on opposing ends of the toothbrush handle.

It is yet another object of this invention to provide an improved toothbrush having an articulating brush on one end thereof.

It is still yet another object of this invention to provide an improved toothbrush wherein the handle design and brush configuration permits the cleansing of the inside of one's teeth while holding the toothbrush in a normal fashion.

SUMMARY OF THE INVENTION

The above and related objects are achieved by providing a toothbrush comprising a handle and two sets of bristles, each of a different design, located on opposing ends of the handle. One set of bristles, attached to one end of the handle, approximates the conventional toothbrush design and is used for cleansing teeth in the conventional manner. The second set of bristles is configured as an independently articulating member which is attached to the opposite end of the toothbrush handle. The "articulation" or "pivoting" of the crescent-shaped brush relative to the toothbrush handle is unique to this invention and provides significant operational enhancements over commercially available toothbrush designs, and those designs previously disclosed in the patent literature. In addition, the handle contour enables proper and continuous contact between the tips of the brush bristles and the inside surface of the teeth to maintain an effective cleansing relationship. More specifically, the configuration of the toothbrush handle is such as to present the tips of the bristles of this second brush in direct opposing relationship to the inside of the user's teeth while holding the handle in the normal manner. The end of this section of the handle is, thus, essentially "C"-shaped so as to align the tip of the crescent-shaped bristles against the inside surface of the user's teeth. The crescent-shaped bristles of this toothbrush are attached to a separate support which is capable of an articulating relationship yet limited pivoted rotation relative to the end of the "C"-shaped section of the handle. The pivoting of the crescent-shaped brush is in response to the contour created by the inside surface of the user's teeth. The user is, thus, able to manipulate the crescent-shaped brush within his mouth with a normal brushing action and yet maintain the bristles in a cleansing relationship without changing his grip or orientation of the handle relative to the brush.

DESCRIPTION OF THE INVENTION INCLUDING PREFERRED EMBODIMENTS

Figure 1:
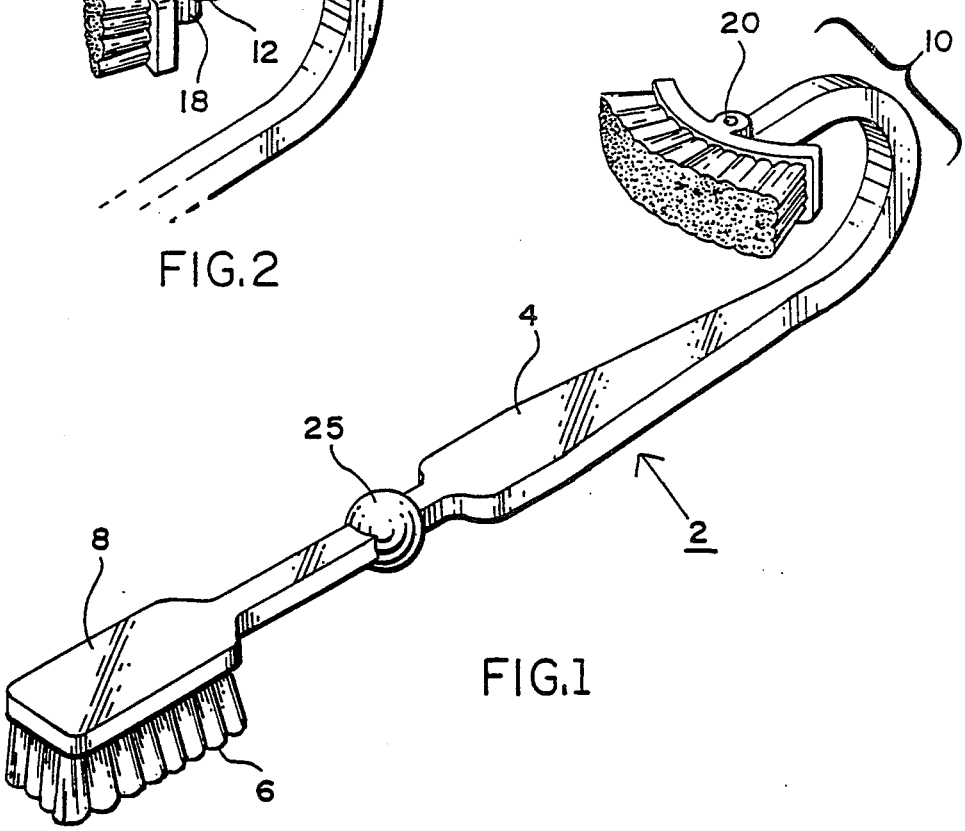
FIG. 1 is a perspective view of the improved toothbrush of this invention.

FIG. 1 illustrates a perspective view of the improved toothbrush of this invention. In the embodiment illustrated in this figure, the toothbrush (2) comprises a handle (4) with two sets of bristles disposed on each end thereof. One set of bristles (6) is configured as a conventional toothbrush and is supported by and integrated into one end (8) of the handle. These bristles can have any one of a number of configurations currently available in the art and is primarily intended for and most efficacious in the cleansing of the front outside surface of the user's teeth. The bristles which make up this brush can include any combination of soft and hard bristles and may take the shape shown in the illustration or some other similar and functionally equivalent design.

The section handle (10) which supports the second set of bristles is unique in its design and is essentially "C"-shaped. The handle is provided with means (12) for attachment to a separate and independent support (14) for a second array of bristles (16). In the configuration of this invention illustrated in FIG. 2, the handle (10) and support pivot relative to one another through what resembles a simple hinge-like arrangement. More specifically, the rear surface of the brush support is equiped with a female fitting (18). A corresponding male fitting (12) is provided on the end of the "C"-shaped handle to engage the female fitting of the brush. The two components are thereafter locked together with a "pin" (20) or other equivalent expedient. This union of the brush and handle is permanent, thereby preventing any unintended disengagement of the brush from the handle while in the mouth of the user.

Figure 2:
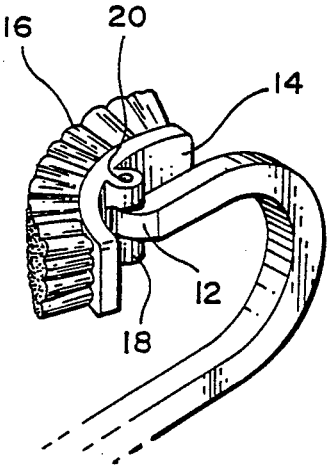
FIG. 2 is an enlarged perspective view of an articulating brush on one end of the tooth brush handle.

This second array of bristles and support comprise a crescent-shaped brush which is designed to conform with the front inside surface of the user's front teeth (hereinafter "front lingual arch"). The manner of attachment of this crescent-shaped brush to the end of the "C"-shaped portion of the handle insures the placement of the tips of the bristles in cleansing relationship with the inside surface of this front lingual arch. The hinge-like means for attachment of this crescent-shaped brush to the end of the handle is designed to enable pivoting of the crescent-shaped brush relative to the handle. As illustrated in FIG. 2, the crescent-shaped brush is limited in its pivoting rotation upon contact with the upper horizontally disposed arm of the "C"-shaped handle. This facilitates the cleansing not only of the inside of the teeth in the immediate area of the front lingual arch, but also the inside surface of the teeth toward the rear of the jaw. The lateral articulation (pivoting) of the brush permits the user to maintain essentially the same grip on the handle and yet can clean the inside surface of the teeth on either side of his mouth. The composition of the bristles within this convex brush can be similarly structured to that of the more traditional brush on the other end of the handle. More specifically, it may contain different combinations of bristles at different lengths and different stiffnesses. In addition, the overall linear dimensions of the convex brush may also be varied consistent with the user's mouth. More specifically, it is conceivable that a smaller brush would be used for children and a larger brush for adults.

The handle and the articulating support for the bristles of the brush can be molded from common plastic materials. In order to facilitate ease of molding and manufacture, each of the front surfaces (the brush heads to which the bristles tufts are secured) are generally planer and molded to form a plurality of holes which extends inward and generally perpendicular with their front surface. The bristle tufts are secured within the holes in a conventional manner and extend outwardly and generally perpendicularly with respect to the front surface of the bristle support. The bristle tufts can be uniformly secured within the holes and can be selected to gradually increase in length with a minimum length at the periphery of the front surface to a maximum length at the center front surface in order to provide a generally convex bristle surface.

The toothbrush which is described herein is designed for coordinative use between hand, mouth and teeth of the user. Its general design characteristics provide ease of manipulation and use while providing efficient cleansing and removal of plaque from the user's teeth. This removal of plaque is essential to insuring against peridontal disease, tooth decay, and eventual tooth loss.

In an alternate embodiment of this invention, the conventional portion of the toothbrush can be detachably connected, at the handle, to the portion of the toothbrush intended for cleansing of the inside surface of the teeth. In the embodiment illustrated in the figure, this is represented by the junction (25) in the handle between these two separate components. It is also further contemplated that the individual cleansing components of this composite toothbrush may be adapted to each attach to a power handle of an electric toothbrush (not shown). Thus, in its simplest terms, the invention contemplates not only a composite toothbrush, but also a toothbrush designed specifically for cleansing the inside surface of the user's teeth.

It is to be understood that this invention is not confined to the particular construction and embodiments illustrated herein and described above. The above description is simply intended to be illustrative of this concept and not delineative of the scope, which is set forth in the following claims.

What is claimed is:

1. An improved toothbrush for effective cleansing of both the inside and outside surfaces of an individual's teeth, comprising:

a handle having a relatively straight section with a "C"-shaped section on one end thereof and a conventional toothbrush on the opposite end thereof, the "C"-shaped section being provided at its terminus with hinge-like means for pivoting engagement of a support for a crescent-shaped toothbrush;

a crescent-shaped toothbrush having a bristle bearing suface and a support means, said support means having hinge-like means for pivoting attachment with the engagement means at the terminus of the "C"-shaped handle; and means for limiting the degree of pivoting rotation of the crescent-shaped toothbrush relative to its hinge-like attachment on the terminus of the "C"-shaped handle, whereby the crescent shaped toothbrush can articulate laterally on the terminus of the "C" shaped handle and yet be maintained in a cleansing relationship relative to the front lingual arch.

2. The toothbrush of claim 1, wherein the crescent-shaped tooth brush comprises an essentially planar support and has longer bristles disposed toward the center of the support and shorter bristles toward the edge of the support.

3. The toothbrush of claim 1, wherein the crescent-shaped toothbrush comprises a crescent-shaped support and bristles of essentially uniform length disposed thereon.

4. The toothbrush of claim 1, wherein the section of the handle having the conventional toothbrush can be disengaged from that section of the "C"-shaped handle supportive of the crescent-shaped brush.

5. The toothbrush of claim 4, wherein the relatively straight section of the handle is adapted to a power handle.

6. The toothbrush of claim 4, wherein the section of the "C"-shaped handle is adapted to engage a power handle.

7. An improved toothbrush for effective cleansing of the inside surface of an individual's teeth, comprising:

a handle having a relatively straight section and a "C"-shaped section on one end thereof, the "C"-shaped section being provided at its terminus with hinge-like means for pivoting engagement of a support for a crescent-shaped toothbrush;

a crescent-shaped toothbrush having a bristle bearing surface and a support means, said support means having hinge-like means for pivoting attachment with the engagement means at the terminus of the "C"-shaped handle; and means for limiting the degree of pivoting rotation of the crescent-shaped toothbursh relative to its hinge-like attachment on the terminus of the "C"-shaped handle, whereby the crescent shaped toothbrush can articulate laterally on the terminus of the "C" shaped handle and yet be maintained in a cleaning relationship relative to the front lingual arch.

* * * * *